US006539273B1

(12) United States Patent
Pleschiutschnigg et al.

(10) Patent No.: US 6,539,273 B1
(45) Date of Patent: Mar. 25, 2003

(54) METHOD OF AND APPARATUS FOR AUTOMATICALLY CONTROLLING OPERATION OF A CONTINUOUS CASTING PLANT

(75) Inventors: Fritz-Peter Pleschiutschnigg, Duisburg (DE); Stephan Feldhaus, Dusseldorf (DE); Lothar Parschat, Ratingen (DE); Michael Vonderbank, Xanten (DE); Erwin Wosch, Stolberg (DE)

(73) Assignee: SMS Schloemann-Siemag AG, Dusseldorf (DE)

( * ) Notice: Subject to any disclaimer, the term of this patent is extended or adjusted under 35 U.S.C. 154(b) by 274 days.

(21) Appl. No.: 09/610,412

(22) Filed: Jul. 5, 2000

(30) Foreign Application Priority Data

Jul. 6, 1999 (DE) ..... 199 30 909

(51) Int. Cl.[7] ..... G06F 19/00; B29C 39/00; B22D 11/00; B22D 46/00

(52) U.S. Cl. ..... 700/146; 700/197; 164/451; 164/457

(58) Field of Search ..... 700/146, 147, 700/197, 204, 205; 164/80, 451–455, 457, 151.1–151.5, 154.6, 154.7, 155.1, 155.6

(56) References Cited

U.S. PATENT DOCUMENTS 4,235,276 A * 11/1980 Gilles et al. ..... 164/413
4,469,162 A * 9/1984 Hanas et al. ..... 164/154.5
5,915,457 A * 6/1999 Pleschiutschnigg ..... 164/476
6,179,041 B1 * 1/2001 Pleschiutschnigg ..... 164/452

FOREIGN PATENT DOCUMENTS

CH 646 352 A 11/1984

OTHER PUBLICATIONS

Patent Abstracts of Japan vol. 1995 No. 08 Sep. 29, 1995 & JP 07112260 Nippon Steel Corp. May 2, 1995.

* cited by examiner

*Primary Examiner*—Leo Picard
*Assistant Examiner*—Ryan A. Jarrett
(74) *Attorney, Agent, or Firm*—Herbert Dubno

(57) ABSTRACT

A continuous caster is controlled by a method anticipating the liquidus temperature in the mold of the caster to prevent premature solidification. The temperature in the tundish is measured and based upon the tundish temperature and the resistance time of the molten metal in the tundish, an equivalent liquidus temperature window is defined and the speed of the continuous caster is controlled to maintain this window of operation of the tundish.

16 Claims, 7 Drawing Sheets

Fig. 2.1
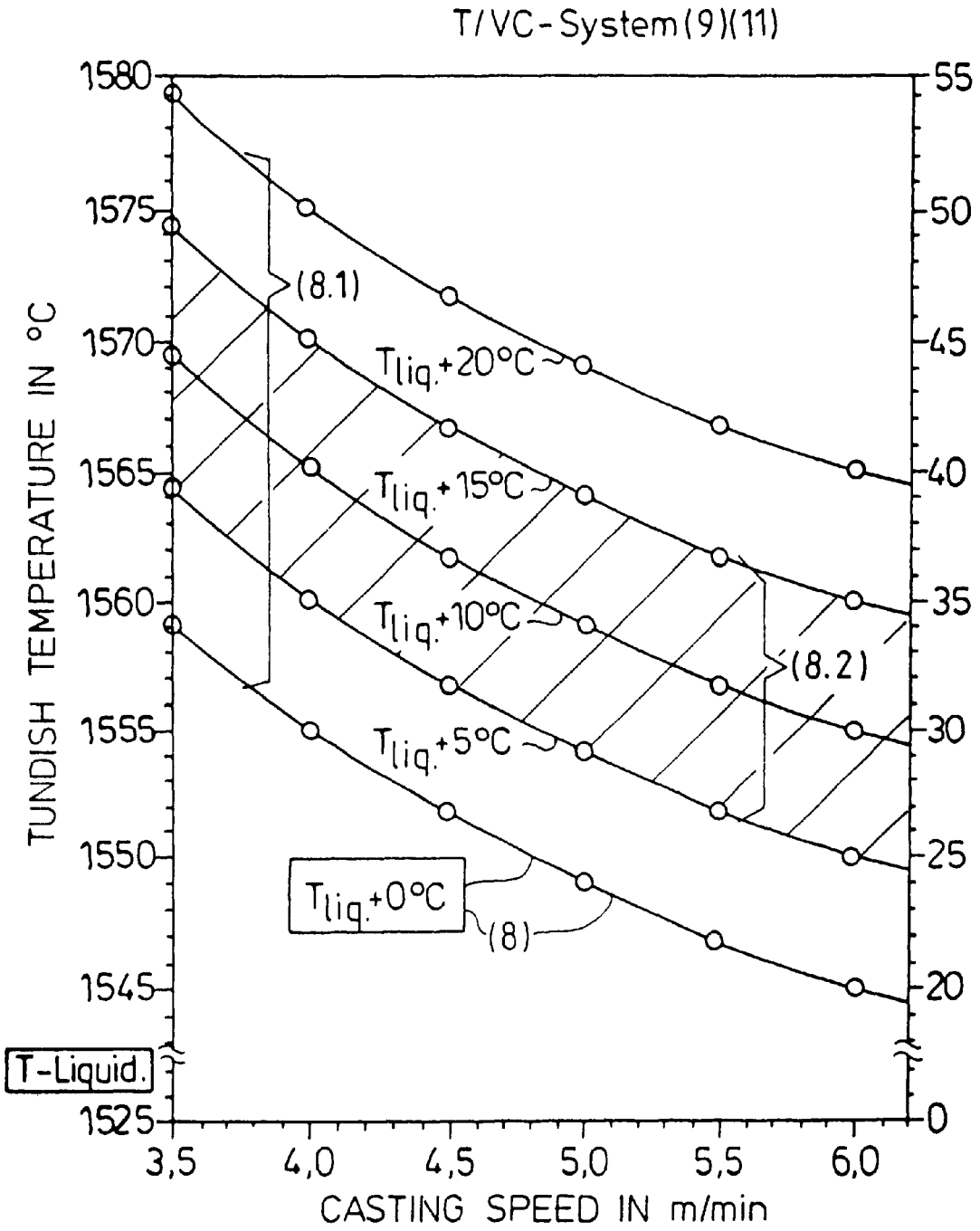

(10.5)
(10.5.1)
D
D.1
D2
(10.5.2)
E
(10.6)

T/VC-System(9)(11)
+20
+15
+10
+5
+0
(8.1)
(8.2)
(8)
B,C
A,D
$T_{liq.}$+°C
0
OVERHEATING IN °C
TUNDISH TEMPERATURE °C
VC in m/min
$T_{liq.}$ in MOLD (10.2)
1500°C
1200°C
(10.1)
A
GG
(10)
0 TIME [min]
$t_{GG}$
100%
(10.3)
B
(10.4)
C
C.1

$T_{liq.}$ in MOLD

METHOD OF AND APPARATUS FOR AUTOMATICALLY CONTROLLING OPERATION OF A CONTINUOUS CASTING PLANT

FIELD OF THE INVENTION

Our present invention relates to a method of and to an apparatus for the automatic control of continuous casting, i.e. the process whereby a metal, especially molten steel, is delivered by a ladle to a tundish or distributor from which the molten metal is delivered to the shaping part of a continuous casting apparatus. Within this shaping part, the molten metal is at least partially solidified to form a slab.

BACKGROUND OF THE INVENTION

Continuous casting as defined above can result in slabs of a variety of thicknesses and can use, as the shaping part of the apparatus, a chilled mold which can have broad and narrow sides and can be oscillated, or a travelling mold or shaping member which can, for example, include a roller or even a pair of rollers in a twin roller system, or a belt arrangement on which the metal is deposited. While the invention will be described here primarily in conjunction with a thin slab continuous casting system utilizing an oscillating mold, the principles of this invention are applicable as well to other kinds of continuous casting of steel.

In recent years, especially in thin slab continuous casting, where the casting speed can be say 8 to 10 m/min, automatic control has become increasingly important to insure product quality and reduced down time.

Indeed, the continuous casting process increasingly attempt to reduce the thickness of the solidifying slab and to increase the casting speed. Apart from thin slab casting using oscillating molds as has been mentioned, belt systems with twin roller casting units and even faster operating casting systems have been provided. The solidification times with thinner products are reduced and one can mention, as examples of solidification times.

16 minutes in the case of automatic slab casting with slabs of say 200 mm in thickness.

1 minute in the case of a 50 mm thick so-called thin slab.

0.1 min (0.6 sec) for a 5 mm thick cast strip.

Casting speeds with these systems can be 1 m/min, 10 m/min and 100 m/min respectively.

It has been recognized that it is important for reliable operation of a continuous casting line of the type described and especially for thin slab casting, to acquire data from the various units by on-line measurement and to establish the casting speed which will result in an optimum solidification in the mold simultaneously with reliable and uninterrupted production and good surface quality of the product. Insufficient cooling in the mold can result in breakthrough and excessive cooling in the mold can restrict the production speed and effect the surface quality.

As a consequence, for a 50 mm thick thin slab, the solidification time in the mold should be about 1 minute. Up to now, casting speeds of about 8 m/min have been used to accomplish optimum cooling, although speeds up to 10 m/min are conceivable and have been approached by reliable casting. For casting speeds of the latter magnitude, exact temperature and speed control are required.

Furthermore, the temperature of the steel within the mold must be so selected that the slab surface is liquid at least until just before the product leaves the mold so that the movement through the mold is not impeded, but there should be no presolidification at the level of the molten metal within the mold. The casting powder which is thrown onto the surface of the melt at this level should be sufficiently molten that it can provide effective lubrication between the molten melt and the mold walls and insulation of the continuous casting or strand during its travel through the mold.

It has been recognized that the temperature of the melt within the mold, for an approximately constant temperature of the steel within the ladle, will be dependent on the actual temperature drop within the mold, the residence time of the steel in the distributor or tundish, the insulation of or radiation from the distributor, measured, for example, as the outer skin temperature of the distributor which can be say 100° C. at equilibrium over say a 30 minute casting time, the radiation of the heat from the pouring or casting nozzles or tubes (submerged entry nozzles or SEN) and the temperature loss of the steel from the beginning of casting over the approximately 30 minute casting time for the heating up of the tundish from about 1200° C. to about 1300° C. to 1500° C. to achieve a temperature equilibrium between the steel and the tundish.

The residence time of the steel in the tundish itself is determined by the tundish size and capacity and thus the maximum and actual quantities of steel in the tundish and the casting output in terms of casting speed and the width and solidification thickness of the cast strand or slab.

In view of these various influences upon the continuous casting process, it is desirable to be able to effect online or continuous control of that process so that the casting rate for speed is maximized in a reliable way and without the danger of breakthrough or shutdown for repair or premature maintenance.

OBJECTS OF THE INVENTION

It is, therefore, the principal object of the present invention to provide an improved method of automatically controlling operation of a continuous casting machine or plant whereby drawbacks of earlier systems are avoided.

It is another object of this invention to provide a continuous casting apparatus with automatic control and hence more efficient operation.

SUMMARY OF THE INVENTION

These objects are attained, in accordance with the invention by the acquisition of a simple parameter or group of parameters which allow the temperature conditions in the mold to be predicted or ascertained within a so-called "incubation time" and permit an optimum casting speed to be established.

More particularly, the method of the invention automatically controls operation of a continuous casting plant in which the molten steel is fed from a ladle to a tundish distributor having controlled outlets opening into a continuous caster and maintaining a level of cast molten steel and in which the molten steel solidifies into a slab. The method can comprise the steps of:

(a) measuring a temperature $T_{dist}$ of the molten steel in the distributor;

(b) detecting a temperature loss in the molten steel over a residence time of the molten steel between the distributor and the level;

(c) determining an equivalent liquidus temperature $T^{e}_{liq.}$+0° C. of the steel in the distributor and a plurality of isotherms $T^{e}_{liq.}$+Z° C. thereof; and (d) controlling a continuous casting speed of the slab so that the temperature $T_{dist}$ measured in step (a) is maintained within an isotherm window $T^e_{liq.}+X°$ C.$<T_{dist}<T^e_{liq.}+Y°$ C., where Z is greater than X and Y, X≠Y, and X, Y and Z are integers preferably x, y and z are multiples of 5 and, in a most preferred state, x=5 and y=15.

In apparatus terms, the apparatus for carrying out the method can comprise:

a mold of the continuous caster;

a temperature measuring device in the tundish;

a device for measuring the steel content of the tundish, means for calculating the temperature loss of the steel between the tundish and the mold, means for the online determination of the equivalent liquidus temperature and its isotherms; and means for controlling the casting speed within the aforementioned isotherm window of the T/VC field, VC being the casting velocity in m/min.

According to a feature of the invention, the method is carried out in a continuous caster with an oscillating casting mold. The coordinates of a melt over the casting time is displayed online in a temperature/velocity (T/VC) scan or system on the computer screen.

It has been found to be advantageous to display the T/VC relationship dynamically as a function of parameters which influence it like the resistance time of the steel in the tundish (dependent upon casting width, casting thickness, true casting speed, true tundish filling height, tundish surface/volume, heating of the tundish from, for example, 1200° C. to its equilibrium temperature with the steel of about 1500° C., and tundish insulation) in an online display.

According to still another feature of the invention, the temperature measurement in the tundish is carried out continuously or discontinuously or both, presumably together with continuous measurement of the degree of filling of the tundish.

Preferably, the casting velocity is automatically adjusted within the aforementioned window. The preferred window is $T^e_{liq}+5°$ C.$<T_{dist}<T^e_{liq}+15°$ C.

The values x and y differ by at least 5 and at most 10 and x, y and z can all be multiples of 5.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
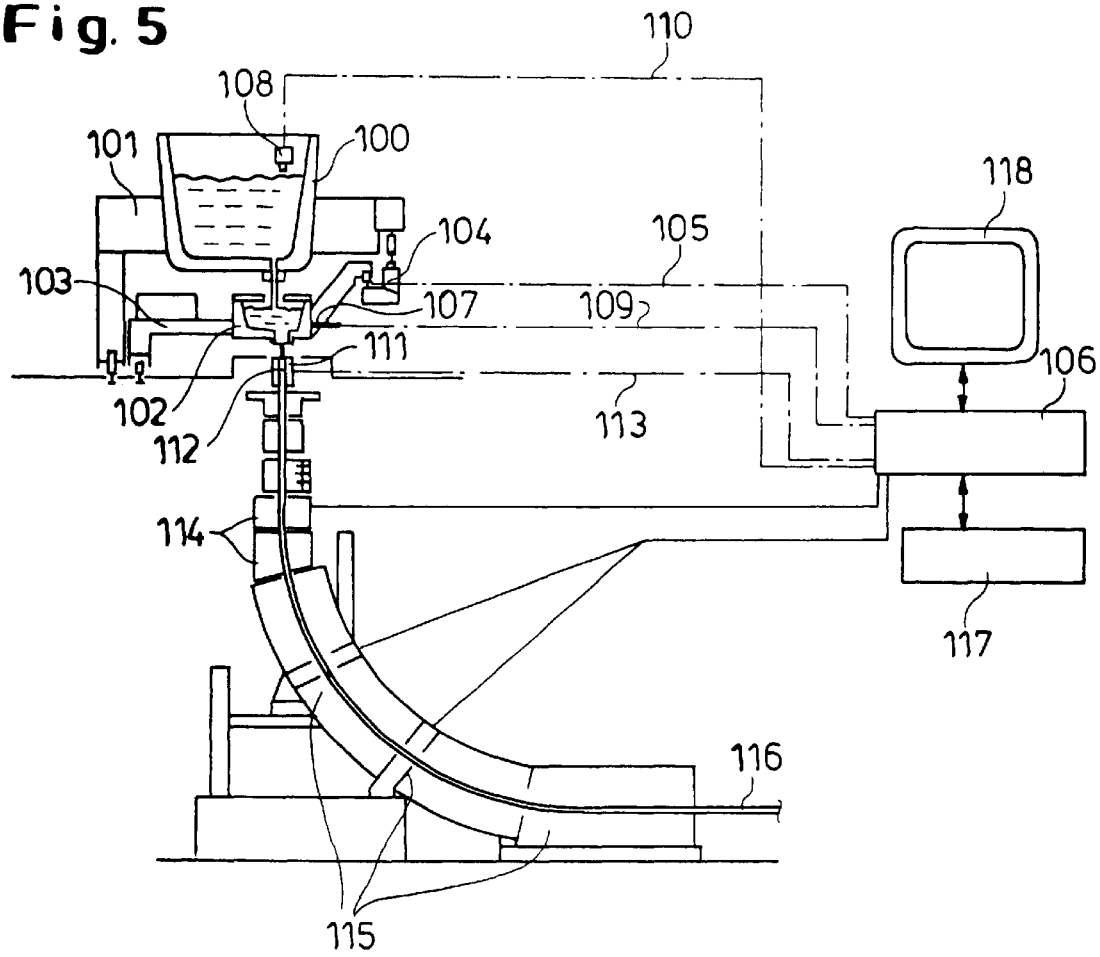
FIG. 5 is a diagrammatic section or a plant or continuous casting machine in accordance with the invention.

Referring first to FIG. 5, it will be apparent that the continuous caster can include a ladle 100 which can be displaced by a ladle carriage 101 so that it can discharge into the tundish 102 on the tundish carriage 103. The degree of filling of the tundish can be detected at 104, e.g. by weight, to provide one input 105 to a computer 106 for controlling the system. The temperature of the melt within the tundish can be detected or measured by a sensor 107 and the temperature of the melt entering the tundish can be detected at 108 to provide additional inputs 109 and 110 to the computer.

From the tundish 102, via casting tubes or nozzles (see FIG. 1) the melt can enter the mold 111 which can be provided with a different measuring 112 providing an input 113 to the computer 106. The continuous caster also includes sets of drive rollers in racks 114 as represented, for example, at 115 which are controlled by the computer 106 to control the speed with which the slab 116 is advanced.

The computer 106 has a keyboard 117 representing the means for inputting instructions into the computer for the control of the caster speed in response to the measured parameters and a display 118 upon which the graphs described below can be shown in an online or real-time basis.

The display on the screen may represent the results averaged over one month's production of the continuous caster.

Figure 1:
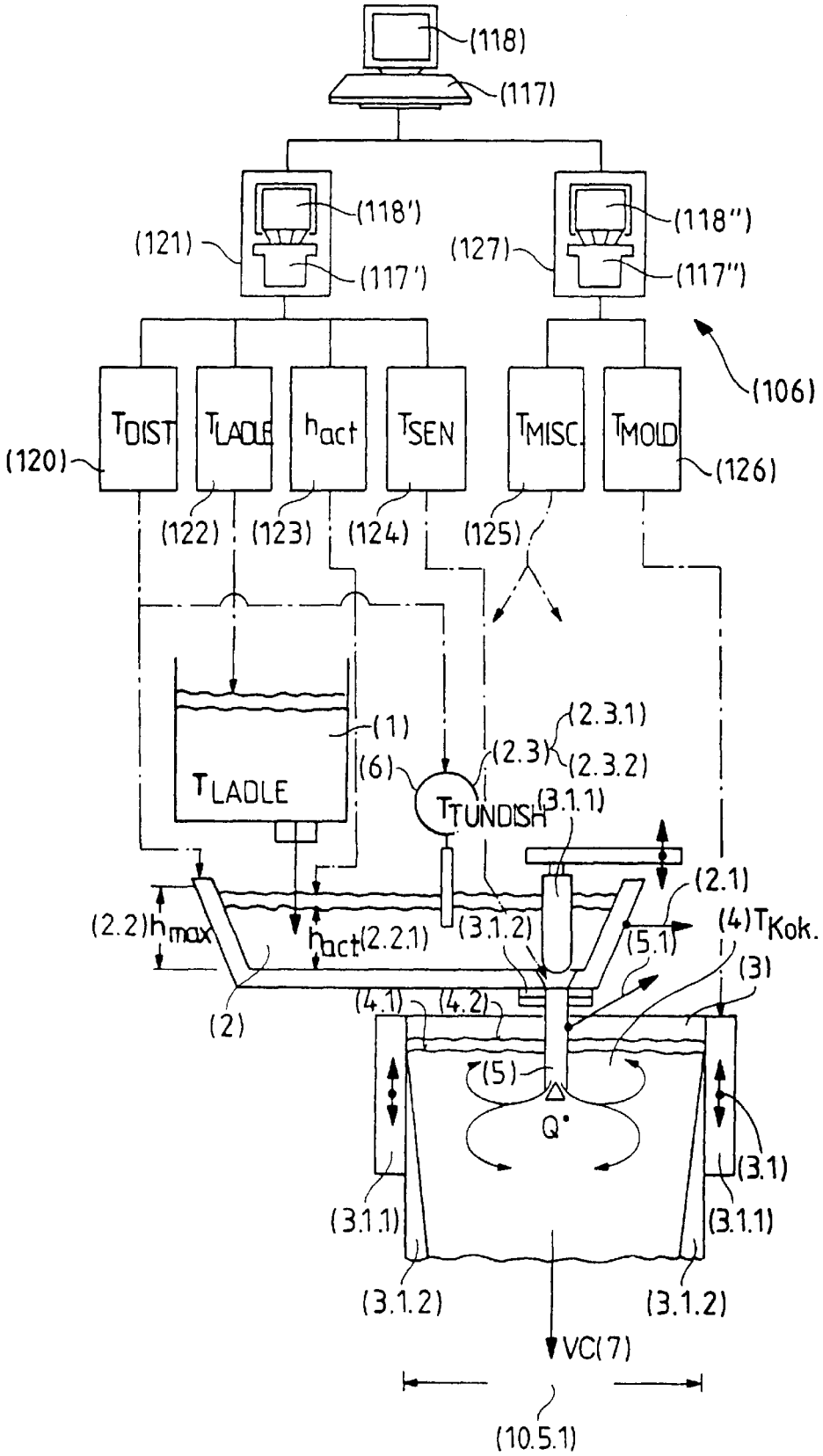
FIG. 1 is a diagram of a portion of a continuous caster showing the significant components for the present invention.
Figure 1A:
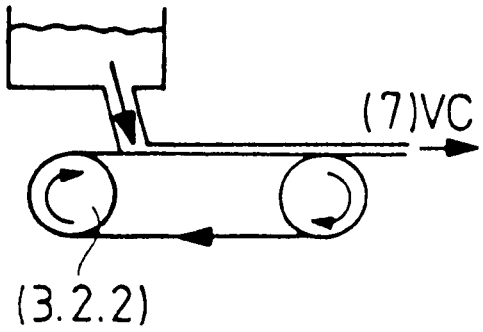
FIGS. 1A and 1B are diagrams showing alternative casting devices.
Figure 1B:
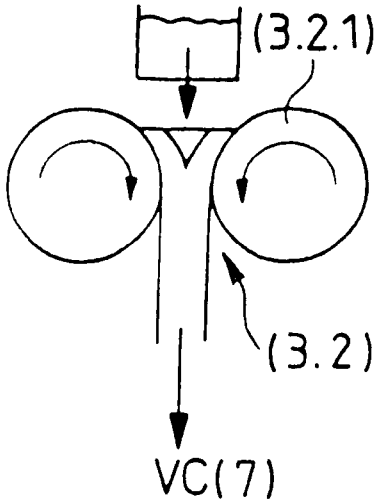

As can be seen in greater detail from FIG. 1, the steel in a ladle 1 at a temperature $T_{ladle}$ is fed to the tundish 2 and via the tundish to the mold 3 shown in FIG. 1 as an oscillating mold in which the oscillation is represented at 3.1. So-called travelling molds 3.2 can be defined as two roller or twin roller molds 3.2.1. (FIG. 1*b*) or as strip molds 3.2.2. (FIG. 1A).

The tundish is in thermal equilibrium with the melt and radiates heat which can result in a skin temperature of the tundish of, for example, 100° C. thereby resulting in a temperature loss of the steel during its resistance time in the tundish.

In addition, the tundish has a maximum weight at its maximum filling height $H_{max}$ represented at 2.2.

The actual filling height $H_{act}$ is measured online and has a direct effect on the temperature loss of the steel in the tundish.

The actual temperature $T_{kok}$ of the melt within the mold is determined at 4 and the temperature measurements can be carried out at 2.3 by a discontinuous process represented at 2.3.1 or a continuous process (preferred) at 2.3.2 within the distributor.

The radiant heat loss from the pouring tube or nozzle 5, whose radiant heat is represented at 5.1, also contribute to the temperature loss in the steel between the tundish and the mold. In general, one can say from a quantitative view point that with half the residence time of the steel or doubling of the casting speed or the width of the slab for a constant solidification thickness and have a constant quality of the steel in the tundish, the temperature loss is halved and with a similar tundish volume, the temperature loss is reduced corresponding to the surface/volume ratio and the residence time.

Figure 2:
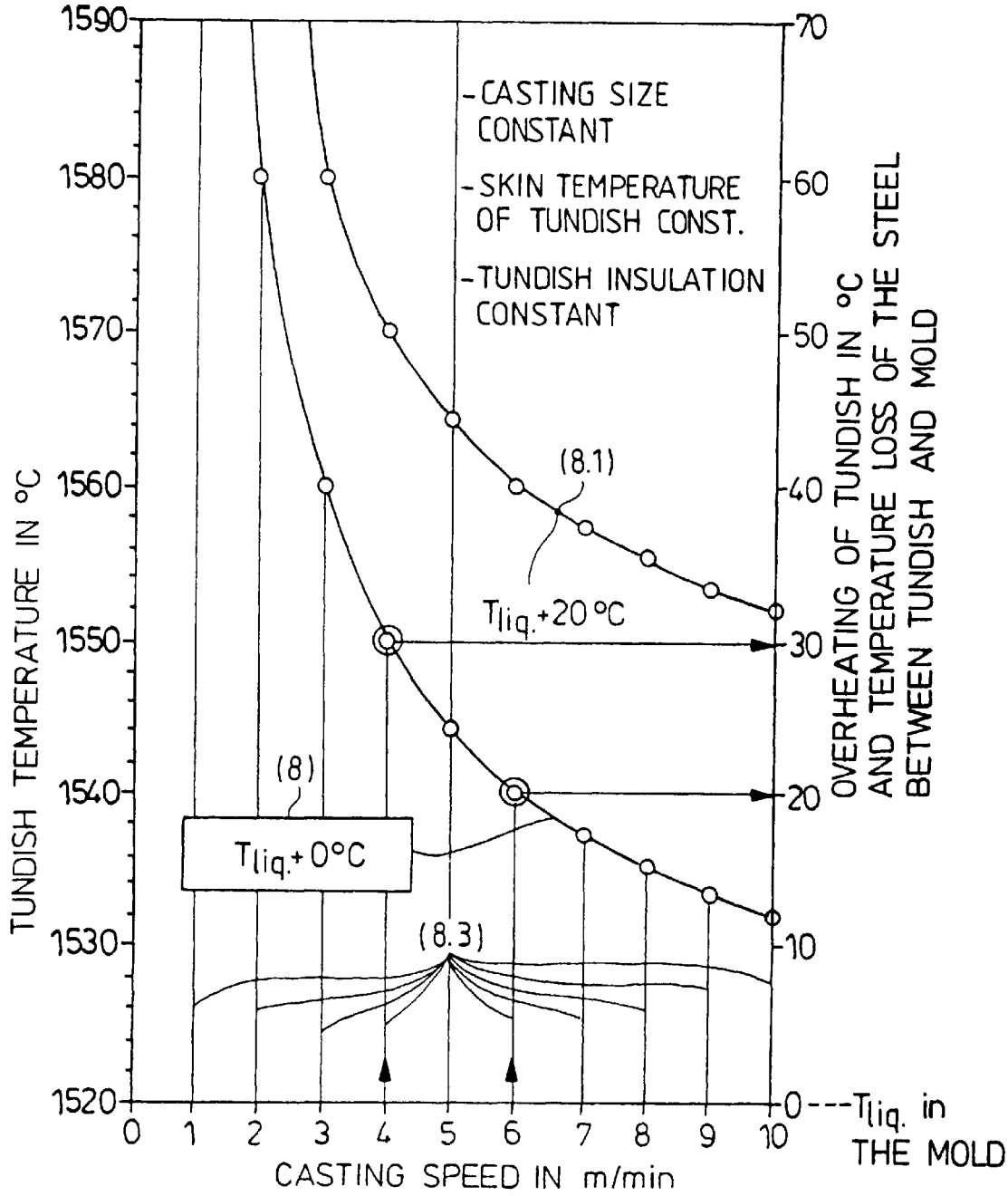
FIGS. 2 and 2.1 are graphs showing the functional relationship between tundish temperature and casting speed in different speed ranges with defined temperature losses of the steel tundish and bath level in the mold for the determination of the equivalent liquidus temperature $T^e_{liq}$, FIG. 2 being relevant for the velocity range of 3.5 to 6.0 m/min of the temperature/speed graph or coordinate system for the liquidus temperature.

FIGS. 2 and 2.1 show the relationship between the tundish temperature 6 and the casting speed 7. Simultaneously these diagrams show the equivalent liquidus temperature $T^e_{liq}$ 8 in the tundish and its isotherms 8.1 ($T^e_{liq}$+X° C. for x=+5 , +10, +15 and +20° C.).

Thus, for example, the constant slab casting size, constant tundish skin temperature and constant tundish volume, the loss of the steel temperature between tundish and mold at 4 m/min is 30° C. and the 6 m/min is 20° C. The diagram shows a $T^e_{liq}$ of, for example, 1500° C. reduced by the temperature losses as a function of casting speed in m/min and thus the functions $T^e_{liq}$+0° C. at 8 in the tundish with isotherms of +5° C., +10, +15 and +20° C. at 8.1.

The equivalent $T^e_{liq}$ temperature in the tundish as shown at 8 indicates the temperature of the tundish at which the steel temperature in the mold 4 is at the liquidus temperature. As long as the liquidus temperature is maintained in the mold, there is no solidification at the melt level 4.1, thereby preventing bridge formation and breakthrough because of lack of slag lubrication or detriment to the cast slab surface.

Reliable casting is only obtainable when the speed is so set that the tundish temperature 6 remains above the isotherm $T^e_{liq}$+5° C. and advantageously the casting window of the tundish temperature ($T_{dist}$) 6 lies between $T^e_{liq}$+5° C. and $T^e_{liq}$+15° C.

Figures 3, 3A, 3B:
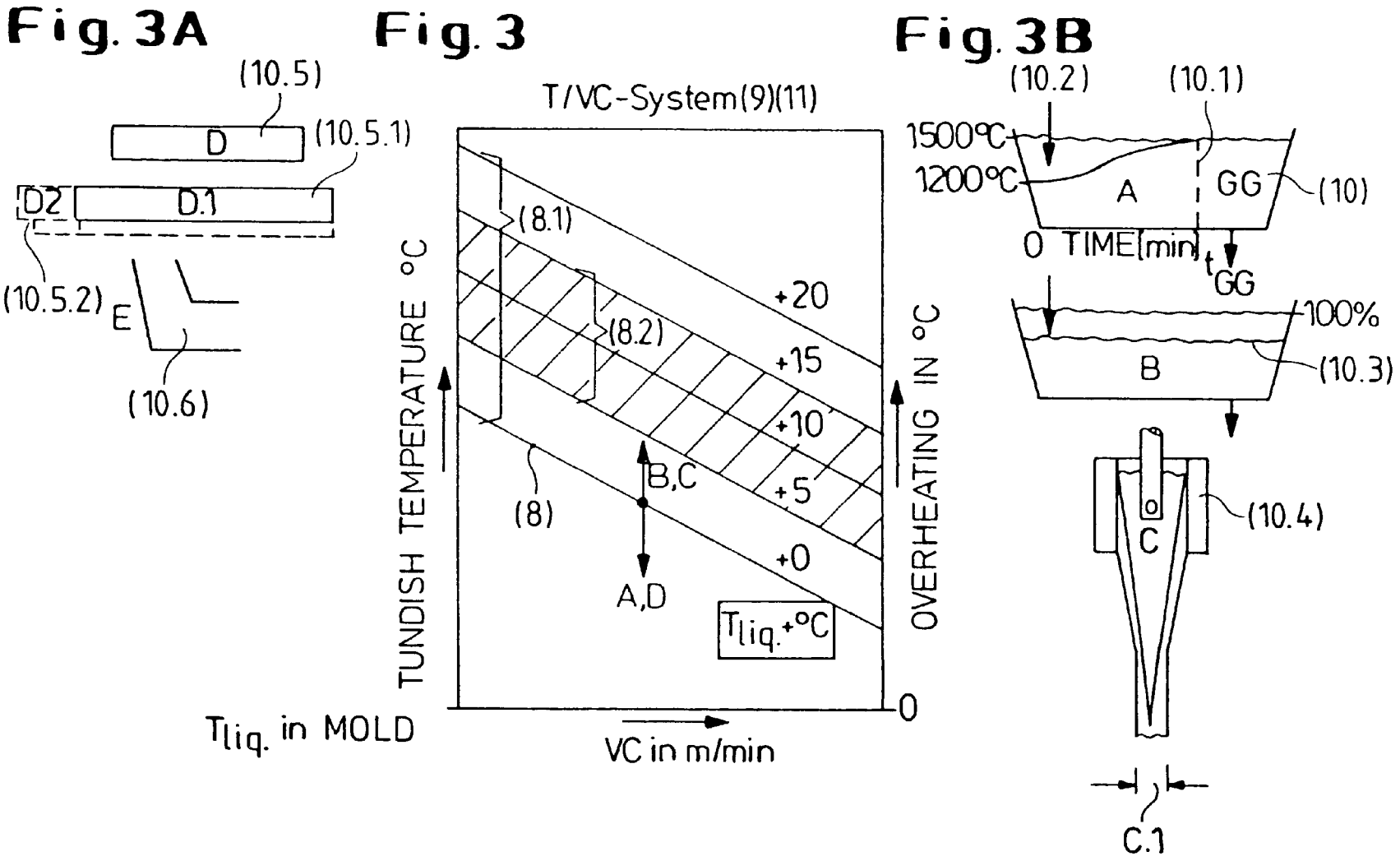
FIG. 3 is a graph showing the shifting of the temperature/speed relationship or coordinate system as a result of different effects.
FIGS. 3*a* and 3*b* are diagrams serving to illustrate those influences.

FIG. 3 shows the speed/temperature graph 9 T/VC or its coordinate system. Simultaneously, the graph shows the effects which shift the T/VC graph to higher or lower temperature sides. Thus the temperature loss 8.3 is increased by comparison to the equilibrium GG 10 with: B, the reduction of the tundish weight 10.3 as a function of the surface/volume ratio and the resistance time, and C, the liquid core reduction 10.4 from one thickness in the mold to a smaller solidification thickness claim 1.

The temperature loss is reduced with increasing casting rate (10.5) as follows:

A heating of the tundish 10.2 following casting of the first melt of a sequence over a time $t_{GG}$ of about 20 to 30 min (10.1) to a constant value which corresponds to the equilibrium between tundish and melt, D1, the casting width 10.5.1, D2, the solidification thickness (10.5.2) and with E improved insulation 10.6 of the tundish wall or reduction of the external skin temperature of the tundish and loss of heat from the casting tubes.

With these effects taken into consideration, the T/VC graph 9 is dynamically modified at 11 and can, during the casting utilizing the online process date by continuously displayed in real time.

Figure 4:
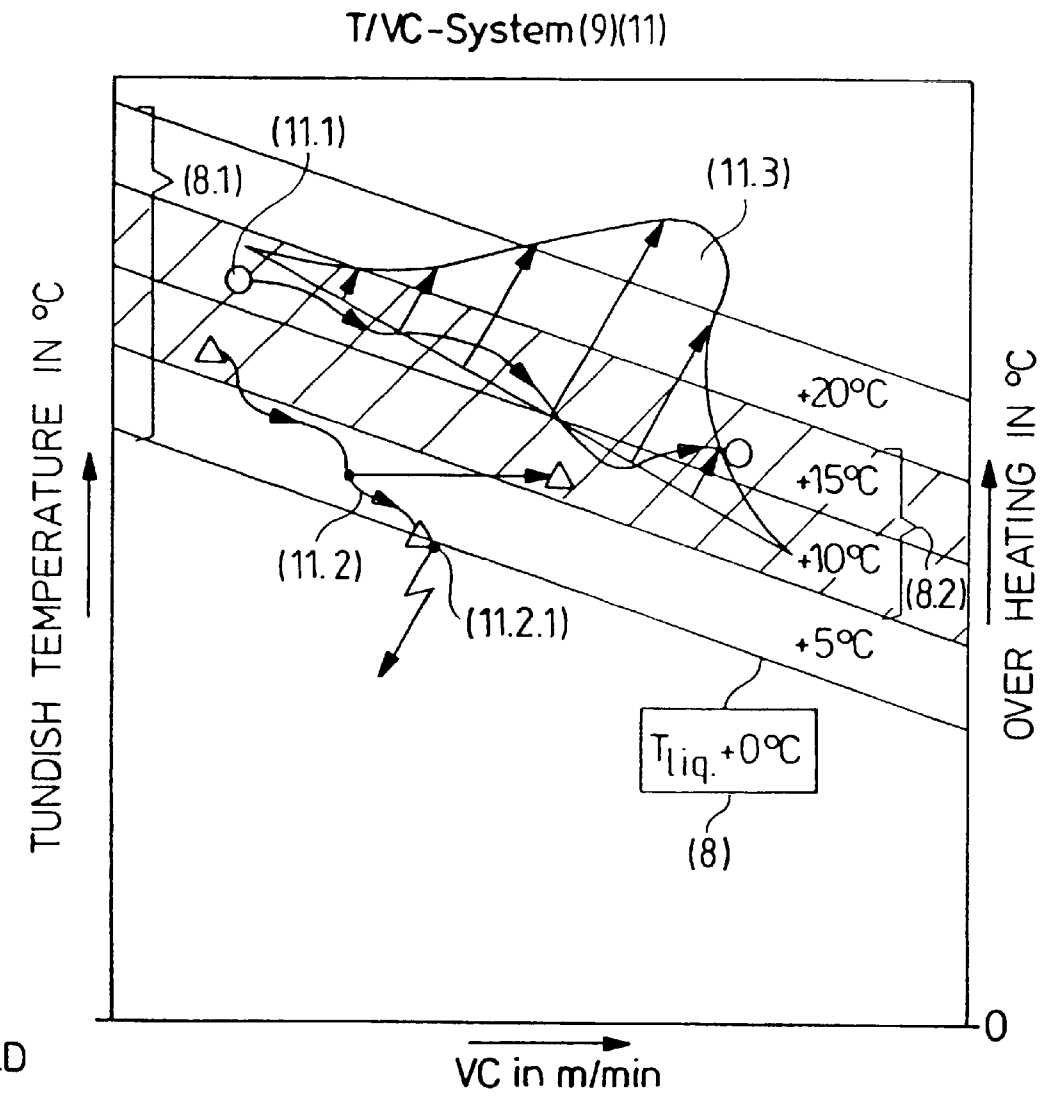
FIG. 4 is a diagram of an online display of the graph showing the case of breakthrough and control of the casting process in accordance with the invention.

FIG. 4 shows the dynamic T/VC screen 11 displayed at 118 for an actual melt or sequence 11.1 in which the speed is optimally selected for the particular tundish temperature. A further run in the T/VC screen 9 is shown at 11.2 in which the slab is cast too slowly and the temperature in the mold $T_{kok}$ reaches the liquidus temperature $T_{liq}$ which corresponds to a $T_{dist}$ 6 of $T^e_{liq}$+0° C. and breakthrough occurs at 11.2.1. This breakthrough is a result of presolidification at the level of the melt in the mold and interference with slag lubrication between the slab and the mold plates.

The data which is displayed at FIG. 4 for the graph T/VC can be accumulated for a month, for example, and can be statistically used to determine the optimum window and speed to maintain the melt temperature in the mold above the liquidus temperature simply by continuous measurement of the tundish parameters. The detection of the steel temperature 2.3 by the discontinuous method 2.3.1 and/or a continuous measurement 2.3.2. in the tundish and the collective online determination of the temperature loss of the steel between tundish and mold enables optimum fully automatic control of casting free from breakthrough solely based upon the steel temperature in the tundish and the equivalent liquidus temperature $T^e_{liq}$ of the steel in the tundish and the aforementioned isotherms at +5° C. through +20° C. at 8.1.

The optimum casting speed can advantageously be so selected that the temperature in the mold $T_{kok}$ is represented by the relationship $T_{liq}$+5° C.+$T_{kok}$<$T_{liq}$<15° C. and a relationship of the equivalent temperature of $T^e_{liq}$+5° C.<$T_{dist}$<$T^e_{liq}$+15° C.

This graphing of T/VC, surprisingly, can provide sufficient time for the system to react to cooling of the melt in the mold and thereby eliminate casting defects or breakthrough. The measurement of the conditions in the tundish is thus a predictor of the process which the melt undergoes in the mold and because of the relatively long residence time of the steel in the tundish, usually about 8 minutes, there is adequate time for speed regulation.

The computer system 106 can have, in addition to the display 118 and the keyboard display 117 previously mentioned, respective processors 120 for detecting the distributor/tundish temperature and converting it into a signal which is supplied to a signal processor 121 capable of displaying a specific parameter on a display 118' as determined by operation of the selector buttons 117'. Similarly, the ladle temperature signature is delivered by the signal processor 122, the height of the melt in the tundish is converted into a signal by the processor 123 and supplied to the signal processor 121 and the temperature of the submerged delay nozzle and the components thereof is processed by the processor 124. Other temperatures as may be relevant are processed by the processor 125 and the mold temperature is processed at 126, the two latter parameters being supplied to the processing and display unit 127 with its screen 118" and selector 117".

We claim:

1. A method for automatically controlling operation of a continuous casting plant wherein molten steel is fed from a ladle to a tundish distributor having controlled outlets opening into a continuous caster maintaining a level of cast molten steel and in which the molten steel solidifies into a slab, said method comprising the steps of:

(a) measuring a temperature $T_{dist}$ of the molten steel in said distributor;

(b) detecting a temperature loss in the molten steel over a residence time of said molten steel between said distributor and said level;

(c) determining an equivalent liquidus temperature $T^e_{liq}$+0° C. as a limiting equivalent temperature for the molten steel in said distributer based on said temperature loss and for achieving at said level in said caster a limiting liquidus temperature $T_{liq}$ for a given continuous casting speed;

(d) determining a succession of isotherms of the equivalent liquidus temperature in said distributor differing from said limiting equivalent temperature by a certain number of degrees for respective casting speeds assigned to the equivalent liquidus temperatures of said succession; and (e) controlling an actual continuous casting speed of the slab to match one of said respective casting speeds to maintain an actual measured temperature $T_{dist}$ in said distributor within an isotherm window between the isotherms determined in step (d) and having as its lowest limit the equivalent liquidus temperature $T^e_{liq}$+0°.

2. The method defined in claim 1 wherein said isotherms differ stepwise by 5° C.

3. The method defined in claim 2 wherein said actual casting speed is so controlled that the temperature of the molten steel in said distributor lies along or above the equivalent liquidus temperature $T^e_{liq}$+5°.

4. The method defined in claim 3 wherein the actual casting speed in step (e) is selected such that the temperature of the molten steel in said distributor lies along or below the equivalent liquidus temperature $T^e_{liq}$+20°.

5. The method defined in claim 4 wherein a temperature/casting speed graph is displayed online on a display screen.

6. The method defined in claim 5 wherein said graph is displayed dynamically as a function of at least one of the parameters:

residence time of the steel in the distributor, heating of the distributor from a temperature of 1200° C. to an equilibrium temperature with the steel of about 1500° C., and distributor insulation.

7. The method defined in claim 6 wherein said graph is displayed as a function of a parameter representing the resistance time of the steel in the distributor and selected from casting width, casting thickness, true casting speed, true distributor filling level and distributor surface/volume ratio.

8. The method defined in claim 2 wherein the temperature is measured in step (a) discontinuously and/or continuously.

9. The method defined in claim 1 wherein the degree of filling of said distributor is measured continuously as a measurement of the residence time of the molten steel between said distributor and said level.

10. The method defined in claim 9 wherein step (e) is carried out automatically.

11. The apparatus for automatically casting a slab of steel comprising:

a continuous casting plant having a mold, a tundish distributor opening into said mold and a ladle for introducing molten steel into said distributor;

a temperature measuring device in said distributor for measuring a temperature $T_{dist}$ of the molten steel in said distributor;

means for measuring the content of molten steel in said distributor;

computer means for calculating a temperature loss between said distributor and said mold and for online determination of an equivalent liquidus temperature $T^e_{liq.}$+0° C. as a limiting equivalent temperature for the molten steel in said distributer based on said temperature loss and for achieving at said level in said caster a limiting liquidus temperature $T_{liq}$ for a given continuous casting speed and for determining a succession of isotherms of the equivalent liquidus temperature in said distributor differing from said limiting equivalent temperature by a certain number of degrees for respective casting speeds assigned to the equivalent liquidus temperatures of said succession; and controlling an actual continuous casting speed of the slab to match one of said respective casting speeds to maintain an actual measured temperature $T_{dist}$ in said distributor within an isotherm window between the isotherms and having as its lowest limit the equivalent liquidus temperature $T^e_{liq}$+0°.

12. The apparatus defined in claim 11, further comprising means connected to said computer for displaying a graph of the isotherm in a distributor temperature/casting speed diagram and parameters thereof.

13. The apparatus defined in claim 12 wherein said mold is an oscillating mold and the casting speed is a maximum of 10 m/min.

14. The apparatus defined in claim 13 wherein the speed of casting of a slab by said caster is so controlled that the steel temperature in the distributor is within the temperature window $T^e_{liq}$+5° C.<$T_{dist}$<$T^e_{liq}$+15° C.

15. The apparatus defined in claim 14 wherein said graph is displayed dynamically as a function of a parameter of the melt to be cast.

16. The apparatus defined in claim 15 wherein the speed of the caster is controlled automatically on the basis of said window of the dynamic graph.

* * * * *